US005950953A

United States Patent [19]

Baugh et al.

[11] Patent Number: 5,950,953

[45] Date of Patent: Sep. 14, 1999

[54] REEL WITH ADJUSTABLE FLEET ANGLE

[75] Inventors: Benton F. Baugh, 14626 Oak Bend, Houston, Tex. 77079-6441; Scott L. Coates, Harris County, Tex.

[73] Assignee: Benton F. Baugh, Houston, Tex.

[21] Appl. No.: 09/014,290

[22] Filed: Jan. 27, 1998

[51] Int. Cl.[6] ..... B65H 57/14

[52] U.S. Cl. ..... 242/397.3; 242/157.1

[58] Field of Search ..... 242/157.1, 391.3, 242/397.2, 397.3; 166/77.2

[56] References Cited

U.S. PATENT DOCUMENTS

| | | | |
|---|---|---|---|
| 2,660,382 | 11/1953 | Wilson | 242/157.1 |
| 3,552,682 | 1/1971 | Walsh | 242/397.3 |
| 3,809,334 | 5/1974 | Beurer et al. | 242/397.3 |
| 4,410,297 | 10/1983 | Lynch | 242/397.3 |
| 4,583,700 | 4/1986 | Tschurbanoff | 242/397.2 |
| 4,767,073 | 8/1988 | Malzacher | 242/397.3 |

FOREIGN PATENT DOCUMENTS

| | | | |
|---|---|---|---|
| 892 791 | 7/1949 | Germany | 242/157.1 |

*Primary Examiner*—John P. Darling

[57] ABSTRACT

A reel for receiving, storing, and paying out a cable, hose at a predetermined fleet angle between upper and lower guides which control the position of said cable, hose on a drum, said predetermined fleet angle being adjustable to a higher or lower angle by moving the guides from position to position around a portion of the circumference of the reel.

20 Claims, 3 Drawing Sheets

REEL WITH ADJUSTABLE FLEET ANGLE

BACKGROUND OF THE INVENTION

The field of this invention of that of reels for the receiving, storage, and deploying of cables, hoses, and the such like. Many reels have been manufactured with a familiar diamond pattern lead screw mechanism to cause the line being wound onto the drum of the reel to be wrapped in an orderly and compact fashion. Probably the most common of these is the fishing reel.

Most reels, including the fishing reel, have a known receiving and deployment angle or fleet angle for its service. In the case of the fishing reel, it is always toward the end of the fishing pole.

Offshore drilling systems have reels with capacities of up to 12,000 feet of 1.500" outside diameter cable for controlling of subsea blowout prevention equipment. As various offshore and deepwater rigs are designed and built for this service the receiving and deployment angle for the reels will depend on the construction of the vessel. In some cases special reels have been built to accommodate the desired fleet angles. In other cases, multiple large pulleys or sheaves are also purchased to change the direction of the cables to fit the installation situation. In one case, custom engineering and fabrication is a cost burden, an in the other case the capital cost of the sheave assemblies are a cost burden.

SUMMARY OF THE INVENTION

The object of this invention is to provide a reel which will allow the fleet angle of the arriving and/or departing cable to be adjusted to match the specification of end users without custom engineering or manufacture.

A second object of the present invention is to allow the fleet angle of the reel to be adjusted in the field as varying needs present themselves, without manufacturing rework.

A third object of the present invention is allow the fleet angle of the reel to be adjusted in the field without having to change the length of the chains connecting the level wind driving mechanism to the level wind mechanism.

DESCRIPTION OF THE PREFERRED EMBODIMENT

Figure 1:
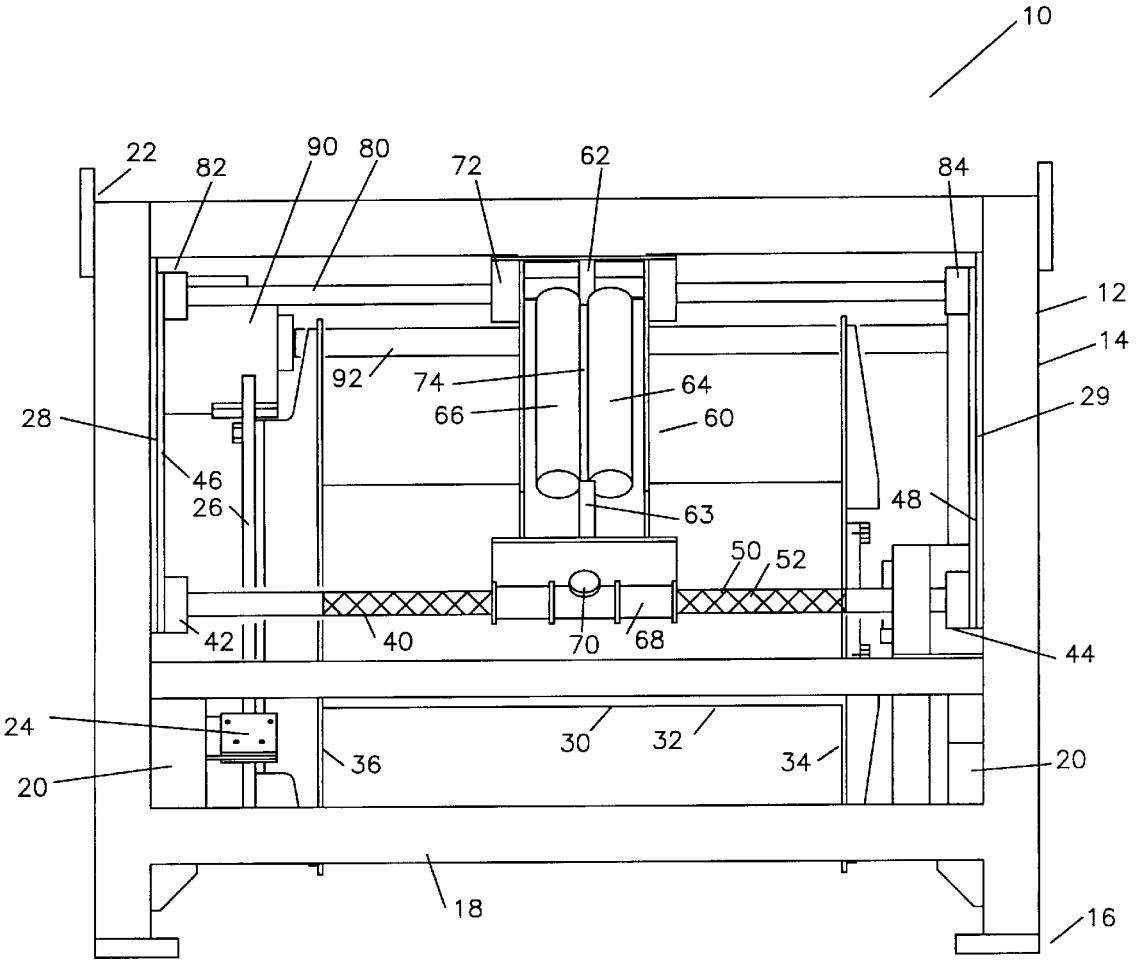
FIG. 1 is a front external view of a reel.

Referring now to FIG. 1, reel 10 comprises a frame 12 including vertical legs 14, feet 16, horizontal members 18, drum supporting hump 20, and lifting eyes 22. Brake drum pads 24 provide for the mounting of brake means (not shown) which work in conjunction with a brake drum 26. Level wind mounting plates 28 and 29 are affixed to each end of the frame.

Drum 30 comprises a core 32, right end flange 34, and left end flange 36.

Lead screw 40 mounts on bearings 42 and 44 on each end which in turn mount on end plates 46 and 48. Lead screw 40 is provided with a right hand spiral groove 50 and a left hand spiral groove 52 which cross each other in a form of a diamond pattern.

Level wind carriage 60 provides upper roller 62, lower roller 63, right roller 64, left roller 66, lower guide 68 including dog 70 and upper guide 72. Gap 74 between the rollers 62, 63, 64, and 66 guides the wrapping of the cable (not shown) as it is wrapped around the drum 32 between the flanges 34 and 36.

Upper roller 62, lower roller 63, right roller 64 and left roller 66 may be a relatively hard steel material or be coated with resilient materials such as rubber or plastics.

Upper guide bar 80 is mounted between bearings 82 and 84 provides for the positioning of the upper end of the carriage 60. In high load cases, the upper guide bar 80 may have a diamond pattern for powering the upper end of the carriage similarly to the way in which the lower end is powered in the present drawings.

Motor 90 connects to drive shaft 92 to provide power to rotate the reel and to operate the level wind mechanisms.

Figure 2:
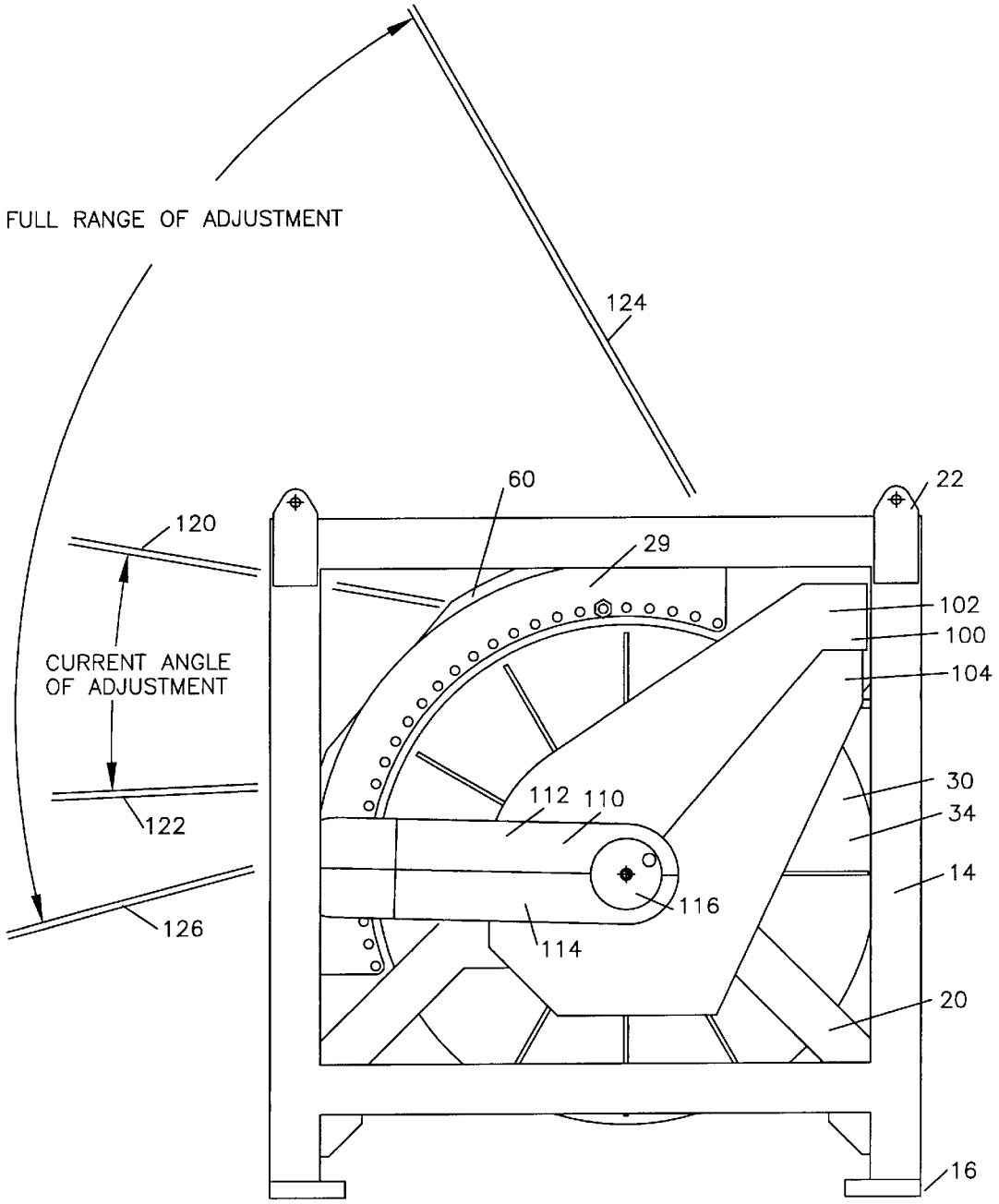
FIG. 2 is a right end external view of the reel.

Referring now to FIG. 2, a right hand end view of the reel in FIG. 1 is shown. Chain guard 100 comprises of upper section 102 and lower section 104 for enclosing the chain drive mechanism to direct the power from the drive shaft down to the centerline of the drum 30.

Chain guard 110 comprises upper section 112 and lower section 114 which directs a portion of the power from the centerline of the reel out to the lead screw 40.

Hand wheel 116 illustrates the position of a clutch means which will allow a person to manually synchronize the position of the levelwind carriage to the correct position for smoothly wrapping cable on the drum.

Cable 120 illustrates the highest fleet angle that cable can come off a full drum within the guide rollers. Cable 122 illustrates the lowest fleet angle that cable can come off an empty drum within the guide rollers. Cable 124 illustrates the highest fleet angle that a cable can come off a full drum with the carriage being adjusted to the maximum upper position utilizing the capabilities of this invention. Cable 126 illustrates the lowest fleet angle that a cable can come off an empty drum with the carriage being adjusted to the maximum lower position utilizing the capabilities of this invention.

Figure 3:
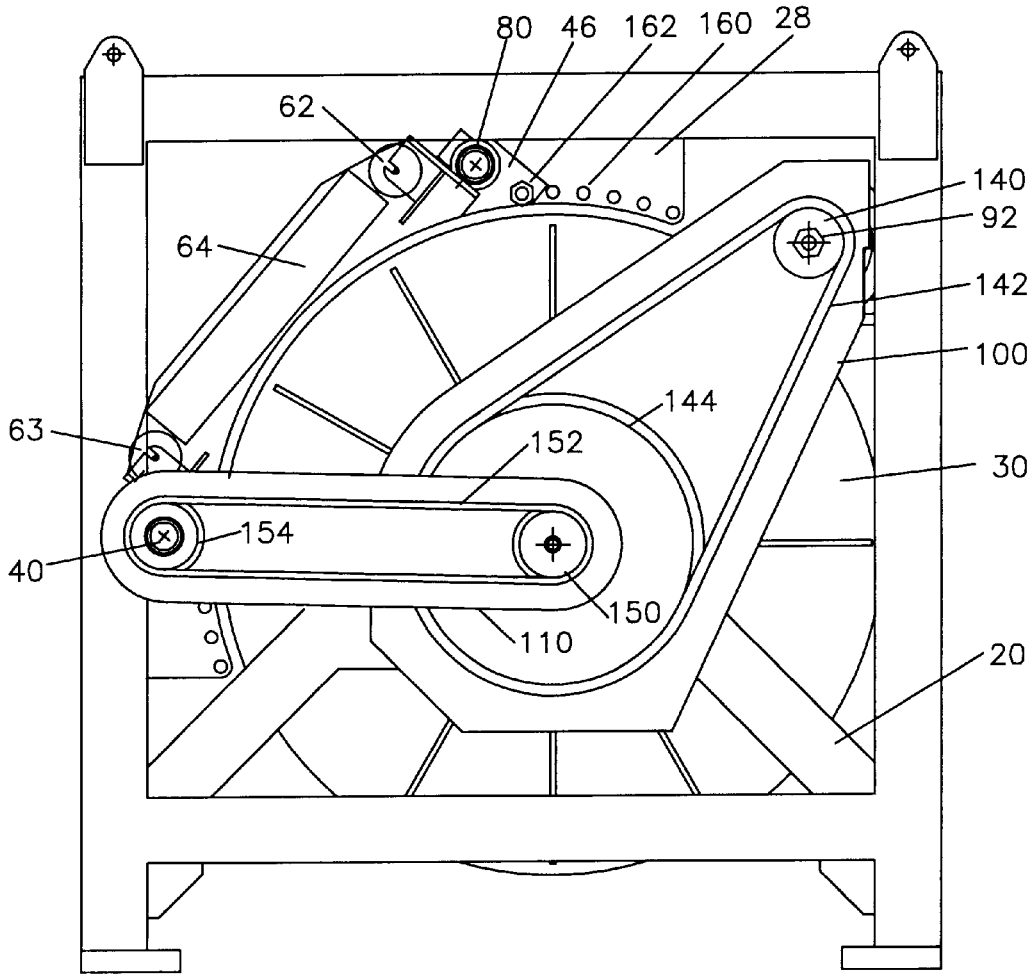
FIG. 3 is a partial section of the right end of the reel opening up the chain guards and the carriage for a better description of the reel. It is not a standard cross section at any point in the reel.

Referring now to FIG. 3, drive shaft 92 is shown mounting small sprocket 140, driving chain 142, and in turn driving large sprocket 144 on the centerline of the drum 30.

A sprocket 150 also attached to the shaft (not shown) of the drum 30 drives the chain 152 and sprocket 154 to rotate the lead screw 40 at a predetermined speed relative to the rotational speed of the drum 30. Continued rotation of the drum in a single direction will cause the carriage to move all the way to one end of the drum, reverse to the opposite groove and return in the opposite direction as is well known in the art.

Level wind mounting plate 28 provides holes 160 for the insertion of bolts 162 to secure the end plate 46 in a first position. In the preferred embodiment, there will be a pair of bolts 162 at each end of the frame in the position as shown and a second set of similar bolts in a lower position which is presently covered by the chain guard 110.

If the angle provided by the upper roller 62 and the lower roller 63 is not satisfactory for a particular application, the operator must simply remove all the bolts 162, move the level wind parts to another position as allowed by other holes 160 and reinsert the bolts. As the holes 160 are spaced circumferentially around the center of the drum 30, these changes can be made without changing the length of the chain 152 or the length of the chain guard 110.

As the bolts 162 which are at the lower end of the end plate 46 are close to the centerline of the level wind shaft 40, the spacing of the holes 160 at the upper end can be moved to a position at a different distance than the current position without impacting the length of the chain 152 or the chain guard 110.

The foregoing disclosure and description of this invention are illustrative and explanatory thereof, and various changes in the size, shape, and materials as well as the details of the illustrated construction may be made without departing from the spirit of the invention.

We claim:

1. A reel for accepting, holding, and deploying cable or hose with an adjustable fleet angle, comprising a drum with a core and end flanges for storing said cable or hose by wrapping said cable or hose around said core, a frame with said drum being mounted in said frame, a level winding mechanism comprising means to control the position of said cable or hose along the width of said drum, said level winding mechanism comprising a carriage having guide means for said cable or hose a drive means which moves said carriage approximately parallel to a rotational center of said drum, said drive means being a distance from said rotational center of said drum said drive means being mounted at each end on a mounting location attached to said frame, two or more of said mounting locations for each end of said drive means being positioned on said frame generally circumferentially about said center of rotation of said drum, such that said drive means and said carriage can be moved from a first mounting location generally circumferentially to a second mounting location to change the fleet angle of departure of said cable or hose from said reel.

2. The invention of claim 1, wherein said guide means comprises an upper roller and a lower roller.

3. The invention of claim 2, wherein said upper and said lower rollers are coated with a resilient material.

4. The invention of claim 1, wherein said drive means is a lead screw.

5. The invention of claim 4, wherein said lead screw is a reversing lead screw.

6. The invention of claim 5, wherein said drive means coordinates the rotation of said lead screw with the rotation of said drum.

7. The invention of claim 4, wherein said lead screw has both left hand and right hand leads which cross in a diamond pattern.

8. The invention of claim 1, wherein said distance from the rotational center of said drum to said drive means does not change when said drive means is moved from said first mounting location to said second mounting location.

9. The invention of claim 8, wherein said drive means comprises a sprocket on the rotational center of said reel and a sprocket on the centerline of a lead screw and one or more chains between said sprockets.

10. A level wind means for a reel having a drum comprising guide means for reciprocal movements across the width of said drum of said reel, said level wind means having a first and a second mounting location circumferentially spaced around said drum.

11. The invention of claim 10, further comprising a level wind shaft having a first sprocket mounted on said level wind shaft, a second sprocket mounted on the center of rotation of said drum, and one or more chains connecting said first sprocket to said second sprocket, such that when said level wind means moves from said first mounting location to said second mounting location, the length of said one or more chains does not need to be changed.

12. The invention of claim 11, wherein a guard is provided for said one or more chains which is free to pivot about the center of rotation of said drum, and does not need to change in length when moving from said first mounting location to said second mounting location.

13. The invention of claim 11, wherein said level wind shaft has both left and right hand leads to allow for said reciprocal movements.

14. The invention of claim 11, wherein said guide means comprises one or more rollers.

15. The invention of claim 14, wherein said guide rollers are coated with a resilient material.

16. The invention of claim 11, wherein said one or more chains rotate said level wind shaft in proportion to the rotation of said drum.

17. A reel for cable or hose, comprising a drum with a core and end flanges for storing said cable or hose by wrapping said cable or hose around said core, a frame with said drum being mounted in said frame, a fleet angle range for said cable or hose approaching or departing said reel between an upper guide means and a lower guide means, a level winding mechanism comprising means to control the position of said cable or hose along the width of said drum, said level winding mechanism comprising a carriage having an upper, lower, left, and right guidance surface for said cable or hose, a reversing drive mechanism which moves said carriage back and forth approximately parallel to the centerline of said drum, drum reversing drive mechanism comprising one or more lead screw means and one or more dogs fixed to said carriage, the centerline of said one or more lead screw means being a first distance from said centerline of said drum said lead screw means being mounted at each end on a mounting location attached to said frame, two or more of said mounting locations for each end of said lead screw means being positioned on said frame generally circumferentially about said axis of said drum, such that said lead screw means and said carriage can be moved from a first mounting location to a second mounting location to change the fleet angle of departure of said cable or hose from said reel with little or no adjustment to the distance of said centerline of said lead screw means to said centerline.

18. The invention of 17 wherein, said upper guide means is a roller.

19. The invention of claim 17, wherein said lower guide means is a roller.

20. The invention of claim 17, wherein said lead screw means has both left hand and right hand leads which cross in a diamond pattern.

* * * * *